United States Patent [19]

Jagger

[11] 4,208,141

[45] Jun. 17, 1980

[54] SERIAL PRINTER WITH CABLE TENSIONING APPARATUS

[75] Inventor: Brian E. Jagger, Union City, Calif.

[73] Assignee: Xerox Corporation, Stamford, Conn.

[21] Appl. No.: 943,905

[22] Filed: Sep. 19, 1978

[51] Int. Cl.[2] ..... B41J 19/00

[52] U.S. Cl. ..... 400/335; 400/320; 267/156

[58] Field of Search ..... 400/144.2, 144.3, 157.2, 400/320, 320.1, 335, 336.1, 336; 267/156; 74/89.22

[56] References Cited

U.S. PATENT DOCUMENTS

| | | | |
|---|---|---|---|
| 2,905,302 | 9/1959 | Hickerson | 400/320 X |
| 3,047,280 | 7/1962 | Pernetta | 267/156 |
| 3,047,281 | 7/1962 | Pernetta | 267/156 |
| 3,424,291 | 1/1969 | Marion | 400/335 X |
| 3,532,204 | 10/1970 | Saşaki | 400/320 X |
| 3,572,489 | 3/1971 | Schaefer | 400/320 X |
| 3,638,220 | 1/1972 | Malina et al. | 267/156 X |
| 3,651,916 | 3/1972 | Becchi | 400/320 X |
| 3,677,384 | 7/1972 | Link | 400/335 X |
| 3,872,960 | 3/1975 | Gabor | 400/320 X |
| 3,884,339 | 5/1975 | Castoldi et al. | 400/320 X |
| 3,954,163 | 5/1976 | Gabor | 400/157.2 X |
| 4,133,422 | 1/1979 | Suzuki et al. | 400/320 X |

*Primary Examiner*—Ernest T. Wright, Jr.
*Attorney, Agent, or Firm*—Barry Paul Smith

[57] ABSTRACT

A serial printer for printing information on a record material is disclosed. The printer includes a frame and a platen mounted on the frame for rotation about its axis, the platen capable of supporting and advancing record material through the printer. A carriage assembly is also included and has a printing member supported thereon, the carriage assembly being supported for movement along a printing path adjacent the platen. Further, a motor is mounted on the frame and means are included for converting the rotary motion of the motor to movement of the carriage assembly along the printing path, the converting means including a cable mounted at either end to the frame. Additionally, means are included for maintaining a substantially constant tension on the cable, the tensioning means including means coupled to an end of the cable for automatically taking up slack in the cable caused by stretching or wear of the cable.

1 Claim, 4 Drawing Figures

SERIAL PRINTER WITH CABLE TENSIONING APPARATUS

BACKGROUND OF THE INVENTION

This invention relates to serial printers and, more particularly, to serial printers of the type comprising a frame; a platen mounted to the frame for rotation about its axis, the platen capable of supporting and advancing record material through the printer; a carriage assembly having a printing member supported thereon, the carriage assembly being supported for movement along a printing path adjacent the platen; a motor mounted to the frame; means for converting the rotary motion of the motor to movement of the carriage assembly along the printing path, the converting means including a cable mounted at either end to the frame; and means for tensioning the cable.

Serial printers of the above type are entirely well known in the art and examples thereoof are disclosed in U.S. Pat. Nos. 3,872,960 and 4,091,911. Commercial printers of this type include the HyType I and II daisy-wheel printers manufactured by Diablo Systems, Inc. of Hayward, California.

Up until now, the cable tensioning means utilized in serial printers of the above-described type employed various types of springs such as compression, extension, constant force compression and flat. An example of a compression spring tensioning device is disclosed in the two above-identified patents. Although these prior art cable tensioning means have worked reasonably well, they are somewhat deficient in providing a substantially constant tension as the cable stretches and wears through prolonged use.

Accordingly, it would be desirable to provide a serial printer of the above-described type wherein the cable tensioning means is capable of maintaining a substantially constant cable tension notwithstanding the effects on tension caused by cable stretching and wearing and the like. It would also be desirable to be able to isolate the tensioning means from the normal operating loads experienced by the carriage assembly's drive system.

SUMMARY OF THE INVENTION

In accordance with the invention, a serial printer is provided for printing information on a record material. The printer comprises a frame; a platen mounted on said frame for rotation about its axis, said platen capable of supporting and advancing record material through said printer; a carriage assembly having a printing member supported thereon, said carriage assembly being supported for movement along a printing path adjacent said platen; a motor mounted on said frame; means for converting the rotary motion of said motor to movement of said carriage assembly along said printing path, said converting means including a cable mounted at either end to said frame; and tensioning means for maintaining a substantially constant tension on said cable, said tensioning means including means coupled to an end of said cable for automatically taking up slack in the cable caused by stretching or wear of the cable.

In accordance with the preferred embodiment, the tensioning means includes a constant force curved spring of the general type disclosed in U.S. Pat. No. 3,047,280. As pointed out in that patent, these springs are obtainable through purchase under the registered trademarks "Neg'ator" and "Tensator". The curved spring is mounted at one end to a rotatable drum that includes a recess with which one end of the cable may be held. The drum is rotatable in a direction to take up slack in the cable, wherein the unique nature of the spring acts to maintain a substantially constant force and tension on the cable.

Also in accordance with the preferred embodiment, a "snubber" post is provided about which the cable is wrapped before it is positioned in the drum recess. The snubber post acts to isolate the spring from the carriage drive loads since the frictional drag of the cable against the post must be overcome, as well as the spring bias, before any unwanted movement of the spring drum and cable will occur, thereby contributing to a more reliable registration of the carriage assembly along the printing path.

These and other aspects and advantages of the invention will be described in detail below with reference to the accompanying drawing.

DESCRIPTION OF THE PREFERRED EMBODIMENT

Figure 1:
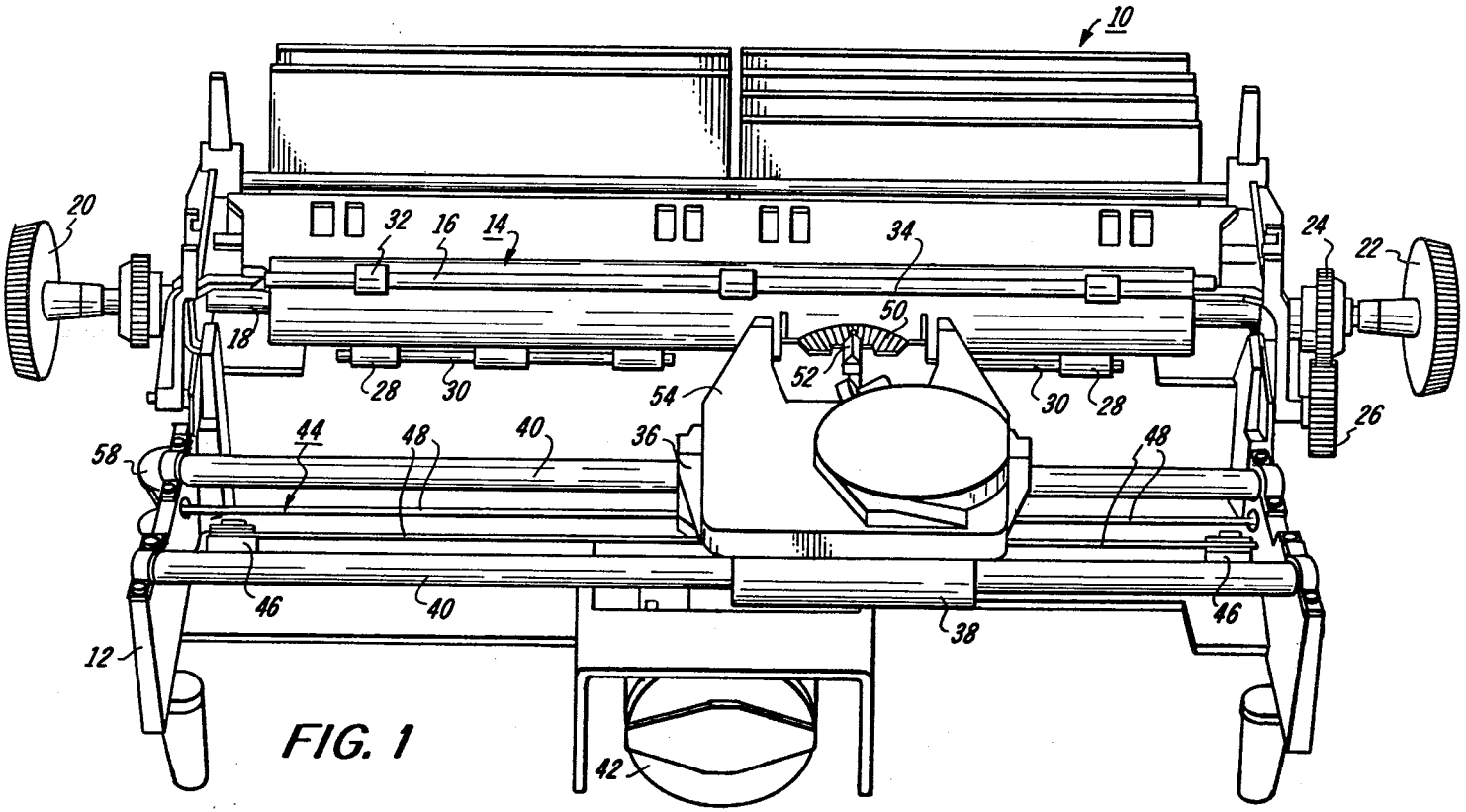
FIG. 1 is a front perspective view of a serial printer incorporating a cable tensioning apparatus in accordance with the present invention.

Referring to FIG. 1, a serial printer 10 is shown including a unitary frame 12 to which a platen assembly 14 is mounted for rotation about its axis. More specifically, the platen assembly 14 includes a platen 16 mounted to a shaft 18 for rotation therewith. The shaft 18 is, in turn, rotatably mounted on the frame 12 and includes a pair of knobs 20 and 22 mounted at respective ends of the shaft 18 for enabling manual controlled rotation of the shaft 18 and platen 16. As is conventional, the knob 20 is fixed to the shaft 18 and the knob 22 is movable axially of the shaft 18 between first and second positions. When in a first position, a gear-drive assembly 24 mounted about the shaft 18 adjacent the knob 22 is engaged with the shaft 18 so that a motor-gear arrangement 26 (only partly shown) coupled to the gear-drive assembly 24 controls the automatic rotation of the shaft 18. When in a second position, the knob 22 disengages the gear-drive assembly 24 from the shaft 18 so that manual rotation of the knobs 20 and 22 will cause a corresponding rotation of the shaft 18 and platen 16.

The platen assembly 14 also comprises a plurality of pressure rollers 28 connected to one or more lower bail bars 30. By way of example, four bail bars 30 are employed (only the front two visible in FIG. 1), each bail bar 30 having three rollers 28 rotatably mounted thereon. The platen assembly 14 further includes an upper bail bar 34 having a plurality, e.g., three, follower rollers 32 rotatably mounted thereon.

Still referring to FIG. 1, the printer 10 also includes a carriage assembly 36 mounted by a pair of bearing members 38 (only one shown) to a respective pair of rails 40 which are themselves mounted on each end to the frame 12 of the printer 10. A drive motor 42 is coupled by a cable-pulley assembly 44 to the carriage assembly 36.

As is conventional, the cable-pulley assembly 44 includes a first pulley (not shown) connected to the shaft (not shown) of the drive motor 42, a plurality (preferably two) second pulleys 46 connected to opposing sides of the frame 12 and a third pulley (not shown) connected to the carriage assembly 36. A cable 48 is mounted at either end to the frame 12 and is wrapped around the pulleys 46 in a manner to be described below for imparting linear motion to the carriage assembly 36 along the rails 40 in response to rotation of the drive shaft of motor 42.

The carriage assembly 36 generally includes and is adapted to transport a rotatable print member 50, which may be a "daisy wheel" type of print wheel and which is mounted for rotation about its axis, a drive motor (not shown) kinematically coupled to the print wheel 50 for controlling the direction and speed of rotation of the print wheel 50, a hammer assembly 52 for impacting an aligned character element on the print wheel 50 against the adjacent support platen 16, a ribbon cartridge 54 for supplying inked ribbon (not shown) between the hammer assembly 52 and platen 16, a ribbon cartridge motor (not shown) for transporting ribbon in front of the hammer assembly 52 during operation of the printer 10, and a ribbon lift mechanism (not shown) for selectively lifting the ribbon in order to print in a second of two colors when the ribbon is of a type having dual-colored portions.

The hammer assembly 52 is actuated to print a selected character element on the wheel 50 after the print wheel 50 has been rotated, if necessary, to bring the selected character element to a stopped position in alignment with the hammer assembly 52. Additionally, hammer impacting will not take place until the carriage assembly 36 is at or has been brought to a stopped position corresponding to the desired linear position for the selected character element to be imprinted. Once the character has been imprinted, the print wheel 50 is controlled to bring a newly selected character element for printing in alignment with the hammer assembly 52, the carriage assembly 36 is moved to a newly desired linear position along the rails 40 adjacent the platen 16, the ribbon in the cartridge 54 is advanced a predetermined increment and the record material (not shown) on the platen 16 is moved, if desired, in an appropriate vertical direction.

Referring now more particularly to the cable-pulley assembly 44 as shown in FIG. 1, it includes the cable 48 whose left-end is engaged with a cable tensioning apparatus 58 mounted on the frame 12. The cable tensioning apparatus 58 will be described in more detail below with reference to FIGS. 2–4. Now then, following the cable 48 from its left end, it continues to the right until it reaches the carriage assembly 36 where it is wrapped 180° around the pulley (not shown) forming part of the carriage assembly 36. The cable 48 then returns to the left where it is wrapped 180° around the left pulley 46. Then the cable 48 proceeds to the right until it reaches the motor 42 where it is wrapped 360° around the pulley (not shown) attached to the motor drive shaft. The cable 48 then continues to the right where it is wrapped 180° around the right pulley 46. The cable 48 then returns toward the left where it is again wrapped 180° around the pulley forming part of the carriage assembly 36. The cable 48 lastly proceeds to the right where its right end is fastened to the frame 12.

A similar, although not identical cable-pulley assembly is disclosed in the aforementioned U.S. Pat. No. 3,872,960. The right cable end fastening device employed in that assembly is also desirably employed in the cable-pulley assembly 44, although it is not shown. On the other hand, the left cable end fastening device employed in that patent, which is a conventional compression spring tensioning device, has been replaced in accordance with the present invention by the constant force cable tensioning apparatus 58.

Figure 2:
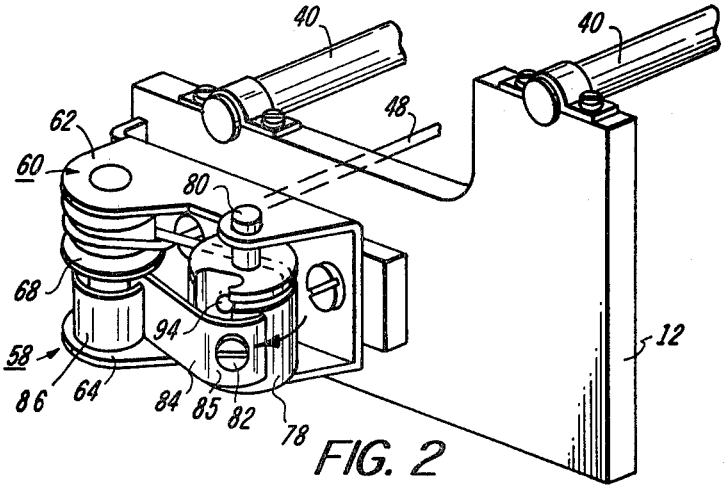
FIG. 2 is a perspective view of the cable tensioning apparatus shown in FIG. 1.
Figure 3:
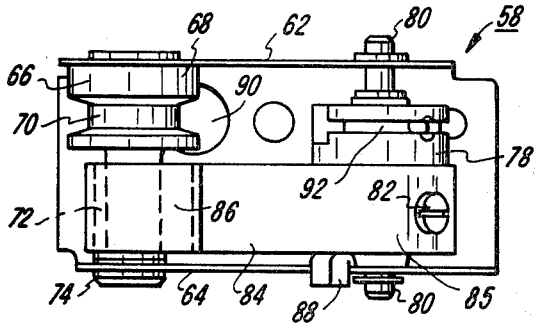
FIG. 3 is a front elevational view of the cable tensioning apparatus of FIG. 2, with the cable deleted for clarity of the remaining parts.
Figure 4:
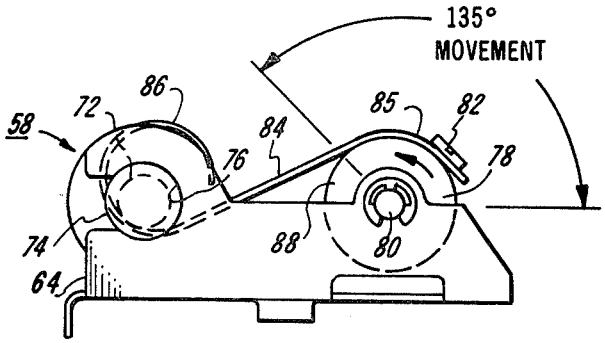
FIG. 4 is a side elevational view of the cable tensioning apparatus of FIG. 3.

Referring now to FIGS. 2–4, the cable tensioning apparatus 58 will be described. As shown, it includes a generally U-shaped mounting plate 60 having opposing side walls 62 and 64. A guide member in the form of a snubber-post 66 is mounted between the side walls 62 and 64 in a manner whereby it is incapable of motion in any direction. The snubber-post 66 includes a main cylindrical base portion 68 having a cylindrical recess 70 formed therein. The snubber-post 66 also includes a cylindrical extension portion 72 that projects axially from the base portion 68 and includes an annular lip 74 fitted within a recess 76 formed in the side wall 64. The cylindrical recess 70 is used to accomodate a 270° wrapped amount of the cable 48 for a purpose to be described below.

The cable tensioning apparatus 58 further includes a cylindrical drum 78 rotatably mounted about an axial shaft 80 disposed through aligned openings in the side walls 62 and 64. Fastened to the peripheral wall of the drum 78 by a screw 82 in the linear-most (right) end portion 85 of a conventional "Neg'ator" (trademark) type curved-coiled spring 84. The coiled (left) end portion 86 of the spring 84 is engaged with the extension portion 72 of the snubber post 66, which acts as a guide for uncoiling movement of end portion 86 during clockwise rotation of the drum 78 (FIG. 4). The drum 78 has a stop flange 88 that engages the side wall 64 which thereby acts as a stop for rotation of the drum 78 counterclockwise (FIG. 4). This direction of rotation is the direction the spring 84 acts to bias the drum 78 towards, as is conventional in Neg'ator type springs. As shown in FIG. 4, the drum 78 can rotate clockwise against the biasing force of the spring 84 until the stop flange 88 again engages the side wall 64.

The left end of the cable 48 is loaded onto the tensioning apparatus 58 through a hole 90 (FIG. 3) in the mounting plate 60. Then, the cable 48 is wrapped 270° around the snubber post 66, fitting in the recess 70 thereof. The cable left end is then brought across the floor of the plate 60 and around a portion of the drum 78 where it is fitted in an annular recess 92 (FIG. 3) formed in the drum 78. An end of the recess 92 includes an open area for accommodating a stop ball 94 (FIG. 1) formed on the left end of the cable 48. The diameter of the ball 94 is larger than that of the recess 92, thereby effectively locking the cable end in the drum 78 and preventing it from being removed upon tensioning of the cable 48.

The cable 48 may be tensioned to a suitable tensioning force by rotating the drum 78 a corresponding amount up to 135° clockwise (FIG. 4), overcoming the bias of the spring 84. Now then, if the cable 48 happens to stretch following prolonged use, the additional slack in the cable 48 will be automatically taken up due to rotation of the drum 78 a like amount counterclockwise under the bias of spring 84, as evidenced by the arrow in FIG. 4. This automatic, self-adjusting feature enables a substantially constant tension to be applied to the cable 48, notwithstanding its stretching through prolonged use.

It should be noted that the snubber-post 66 acts to isolate the spring 84 from the normal operating loads experienced by the drive system for the carriage assembly 36, such drive system including the motor 42 and cable-pulley assembly 44. This isolation is effected since the frictional drag of the cable 48 against the post 66 must be overcome, as well as the bias of the spring 84, before an unwanted movement of the spring 84, drum 78 and cable 48 will occur, thereby contributing to a more reliable registration of the carriage assembly 36 along the printing path.

Although the invention has been described with respect to a presently preferred embodiment, it will be appreciated by those skilled in the art that various modifications, substitutions, etc. may be made without departing from the spirit and scope of the invention as defined in and by the following claims.

What is claimed is:

1. In a serial printer comprising a frame, a platen mounted on said frame for rotation about its axis, a carriage assembly having a printing member supported thereon, said carriage assembly being supported for movement along a printing path adjacent said platen, a motor mounted on said frame, means for converting the rotary motion of said motor to movement of said carriage assembly along said printing path, said converting means including a cable mounted at either end on said frame, the improvement comprising tensioning means for maintaining a substantially constant tension on said cable, said tensioning means comprising:

a mounting member connected to said frame;

a drum mounted on said mounting member for rotation about its axis, said drum including means for engaging and holding said cable end therein, and means for engaging a side wall of said mounting member to limit both clockwise and counterclockwise rotatability of said drum;

a resilient spring of predetermined length having one end connected to said drum and a second normally coiled end; and guide means including a first portion for engaging the normally coiled end of said spring to act as a guide for uncoiling movement of said normally coiled end during rotation of said drum, and a second portion about which a segment of said cable may be wrapped.

* * * * *